US011148311B2

(12) United States Patent
Scimone et al.

(10) Patent No.: US 11,148,311 B2
(45) Date of Patent: Oct. 19, 2021

(54) CUTTING DEVICE

(71) Applicant: SLICE, INC., San Jose, CA (US)

(72) Inventors: Thomas John Scimone, San Jose, CA (US); Scot Herbst, Santa Cruz, CA (US); Hailey Ann Scimone, San Jose, CA (US); William Whitfield Hunter, Santa Cruz, CA (US); Robert Joseph Gallegos, Fremont, CA (US)

(73) Assignee: Slice, Inc., Sunny Isles, FL (US)

( * ) Notice: Subject to any disclaimer, the term of this patent is extended or adjusted under 35 U.S.C. 154(b) by 52 days.

(21) Appl. No.: 16/680,140

(22) Filed: Nov. 11, 2019

(65) Prior Publication Data

US 2021/0138672 A1 May 13, 2021

(51) Int. Cl.
*B26B 27/00* (2006.01)

(52) U.S. Cl.
CPC ..... *B26B 27/007* (2013.01)

(58) Field of Classification Search
CPC ..... B26B 27/00; B26B 27/005; B26B 27/007
See application file for complete search history.

(56) References Cited

U.S. PATENT DOCUMENTS 4,703,561 A * 11/1987 Parisek ..... B26B 27/007 30/298
8,863,758 B1 * 10/2014 Walenciak ..... A45D 29/02 132/73.5
2018/0250841 A1 * 9/2018 Scimone ..... B26B 27/007

FOREIGN PATENT DOCUMENTS

GB 2516106 1/2015

OTHER PUBLICATIONS

Loughborough University News and Events, Jul. 14, 2015, "Graduate awarded 10K and reaches national final for innovative invention," http://www.lboro.ac.uk/news-events/news/2015/july/graduate-awarded-10k-and-reaches-national-final-for-innovative-invention-.html.

* cited by examiner

*Primary Examiner* — Stephen Choi
(74) *Attorney, Agent, or Firm* — Ellenoff Grossman & Schole LLP; James M. Smedley; Alex Korona

(57) ABSTRACT

A cutting device is disclosed. The cutting device has a body member formed from a first material and including a cavity extending along a length of the body member from a first end of the body member to a second end of the body member that is disposed on an opposite side of the body member as the first end, a cutting assembly formed from a second material and attached to the body member, the cutting assembly including a protrusion, and a cutting member disposed on the cutting assembly. The body member includes an aperture extending from the cavity to a third end of the body member that is disposed between the first and second ends. The cutting assembly is attached to the body member based on the protrusion being received in the aperture. The first material is more flexible than the second material.

20 Claims, 8 Drawing Sheets

CUTTING DEVICE

FIELD OF INVENTION

The present disclosure generally relates to a cutting device, and more particularly to a cutting device having a body that may receive a user's finger.

BACKGROUND OF THE INVENTION

The basic utility knife is so named because it allows for performing general or utility knifing functions with the added convenience of easy portability. One of the most common places to use a utility knife is a warehouse in shipping and receiving departments, retail/grocery stores, and restaurants/fast food establishments. With the utility knife, workers can cut open packages, cut string or strapping material, and snip adhesive materials (e.g. tape). With all these functions, it is a tremendous bonus to be able to easily transport and store the utility knife so that it is readily available at a moment's need without compromising safety.

However, there are some drawbacks to the basic utility knife. One of the main disadvantages of the basic utility knife is that although technically it requires a single handle for use, in practical applications two hands are required. Whereas one hand operates the utility knife, often the other hand is used to brace the object to be knifed. This bracing is often necessary for two purposes: (i) to ensure that the object does not move during the cutting process and (ii) to ensure mechanical efficiency. When using a utility knife, typically the bracing hand is in close proximity to the cutting hand to approach a task in a balanced body position. Unfortunately, this violates one of the cardinal rules of utility knife safety: keep the body away from the cutting line. Even if the bracing hand is not in close proximity, a distraction or slipping of the hand can easily cut the triggering hand. Thus, although the retractable blade of a utility knife does have significant safety features, the practical use of such a knife nevertheless poses some logistical safety concerns.

Current utility knifes can also be easily misplaced. For example, when taking a brief work break, it is conceivable that the utility knife can be lost among a pile of cardboard, adhesive tape and/or wrapping tape. Another possibility is while an urgent matter springs up, the user in haste attends to the urgent matter without thought to where the knife was last used. The can lead to "borrowing" of the knife, which may ultimately never be returned.

Therefore, there is a need in the art of a basic utility knife that provides basic utility knife functions with diminished concern for bodily harm or displacement of the knife itself. These and other features and advantages of the present invention will be explained and will become obvious to one skilled in the art through the summary of the invention that follows.

SUMMARY OF THE INVENTION

In one exemplary aspect, the present disclosure is directed to a cutting device. The cutting device includes a body member formed from a first material and including a cavity extending along a length of the body member from a first end of the body member to a second end of the body member that is disposed on an opposite side of the body member as the first end, a cutting assembly formed from a second material and attached to the body member, the cutting assembly including a protrusion, and a cutting member disposed on the cutting assembly. The body member includes an aperture extending from the cavity to a third end of the body member that is disposed between the first and second ends. The cutting assembly is attached to the body member based on the protrusion being received in the aperture. The first material is more flexible than the second material.

In another aspect, the present disclosure is directed to a cutting device. The cutting device includes a body member formed from a first material and including a cavity extending along a length of the body member from a first end of the body member to a second end of the body member that is disposed on an opposite side of the body member as the first end, a cutting assembly formed from a second material and attached to the body member, the cutting assembly including a protrusion, and a cutting member disposed on the cutting assembly. The body member includes an aperture extending from the cavity to a third end of the body member that is disposed between the first and second ends. The cutting assembly is attached to the body member based on the protrusion being received in the aperture. The second material has a greater stiffness than the first material.

Embodiments of the present invention are directed to a safety cutter ring comprising a ring shaped body comprising a blade receiver, wherein the ring shaped body comprises an opening at each a lateral front end and a lateral rear end, wherein the blade receiver is formed on and extends from a bottom edge of said ring shaped body and comprises a cavity formed within walls of the extension of said bottom edge of said ring shaped body, wherein said cavity is configured to retain a blade, and wherein the cavity comprises an aperture within a bottommost wall of the extension from said bottom edge of said ring shaped body to allow for the blade to project outwards away from the ring shaped body.

According to an embodiment of the present invention, the ring shaped body of the safety cutter ring tapers into the blade receiver at both lateral sides, the front end and the rear end.

According to an embodiment of the present invention, the lateral openings of the safety cutter ring are of a different size. Particularly, the front lateral end is of a smaller circumference than the rear lateral end.

According to an embodiment of the present invention, the front and rear later openings of the safety cutter ring are of the same circumference.

According to an embodiment of the present invention, the aperture of the safety cuter ring is located towards a front end of the blade receiver.

According to an embodiment of the present invention, the aperture of the safety cutter ring is transverse along the dorsal side of the blade receiver.

According to an embodiment of the present invention, further comprising of an insert with a cylindrical body with openings at each end to receive a user's finger.

According to an embodiment of the present invention, the insert is removable.

According to an alternative embodiment of the present invention, a safety cutter ring comprises a body comprising of a holding member and a blade receiver member, wherein the holding member has an opening at each a front lateral end and a rear lateral end, and wherein the blade receiver member connects from a bottom wall of said holding member, wherein a cavity configured to retain a blade is formed within the walls of said blade receiver member and wherein said cavity comprises an aperture within a bottommost wall of said blade receiver member to allow for the blade to project outwards, away from the holding member.

According to an alternate embodiment of the present invention, the lateral openings of the safety cutter ring are circular to configure a ring shaped holding member.

According to an alternate embodiment of the present invention, the lateral openings of the safety cutter ring are of a different size. Particularly, the front lateral end is of a smaller circumference than the rear lateral end.

According to an alternate embodiment of the present invention, the front and rear later openings of the safety cutter ring are of the same circumference.

According to an alternate embodiment of the present invention, the aperture of the safety cuter ring is located towards a front end of the blade receiver portion.

According to an alternate embodiment of the present invention, the aperture of the safety cutter ring is transverse along the dorsal side of the blade receiver member.

According to an alternate embodiment of the present invention, the blade receiver member of the safety cutter ring is removable.

According to an alternate embodiment of the present invention, the alternate embodiment further comprises of an insert that fits with the ring shaped cavity that functions to accommodate smaller fingers.

According to an alternate embodiment of the present invention, the insert comprises of a cylindrical body with openings at each end to receive a user's finger.

According to an alternate embodiment of the present invention, the insert of this alternate embodiment is removable.

DETAILED SPECIFICATION

Figure 1:
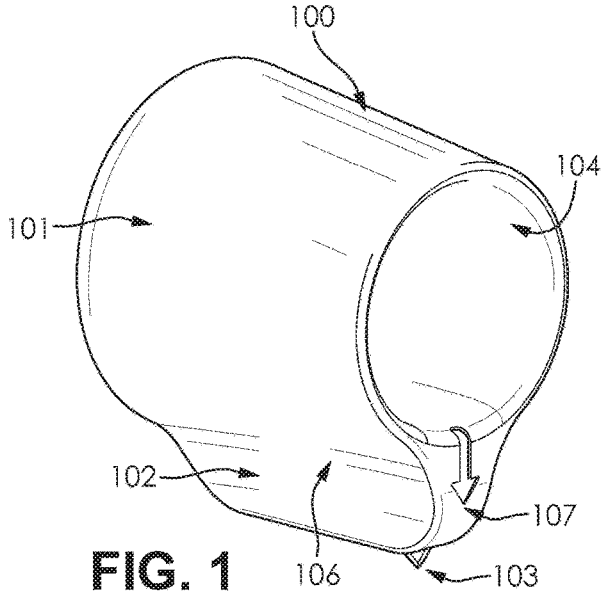
FIG. 1 is a front perspective view of a safety cutter ring with its blade extended in accordance with an embodiment of the present invention.

The present invention generally relates to a cutting device. Specifically, the present invention relates to a general and all-purpose cutting device designed to be worn on the user's finger. Various embodiments of the safety cutter ring include different sizes of openings for the fingers for a more comfortable and secure fit. Other embodiments include an additional insertion that provides a more snug and/or comfortable fit for the finger.

According to an embodiment of the present invention, the safety cutter ring is comprised of essentially three elements: a ring shaped body, a blade receiver, and the blade. Certain embodiments of the present invention may include fewer components or additional components depending on the utilization and purpose for the safety cutter ring.

According to an embodiment of the present invention, the ring shaped body is designed to receive the user's finger. Structurally in the preferred embodiment, it comprises of a tubular configuration with an opening at both the front end and the rear end. These openings allow the safety cutter ring to be worn as if it were a ring.

In alternate embodiments of the present invention, the ring shaped body comprises of an internal component and an external component. The internal component is generally comprised of a hollow, elongated shell. While the preferred embodiment requires the hollow elongated shell to be cylindrical, other embodiments may comprise of some other elongated geometric configuration. Similarly, the external component, while preferentially tubular, can also be adapted to any desired geometrical configuration. When two separate components are utilized in the alternate embodiment, the two components can either be fixed by an adhesion means, for example, an adhesive, or shaped so the internal component fits snuggly within the external component. One of ordinary skill in the art would appreciate that there are many other suitable adhesion means that can be adapted to affix the internal component to the external component.

In the preferred embodiment, the ring shaped body is intended to fit securely over parts of the distal and intermediate phalanges. This preferred positioning provides for optimal use of the present invention. For optimal use, the blade of the present invention should be flush against the cutting surface. Downward pressure from the finger is applied to make meaningful contact between the present invention and the cutting surface. The upper portion of the finger, which includes the distal and intermediate phalanges, has greater dexterity than the lower finger, which includes parts of the intermediate and proximal phalanges, to control the angle of the blade so that the blade can be even with the cutting surface.

In connection with dexterity, the distal phalanges of the upper finger portion support use of the present invention by better receiving sensory information than the lower finger portion. This sensitivity to sensory information is useful for guiding the present invention through use since the blade of the present invention is not in view during operation. Accordingly, the user must be able to sense the location of the blade and be able to gauge how much pressure is necessary to depress the present invention to enable cutting/slicing of the desired surface. The upper finger portion is more suitable for this task by comprising of apical tufts which support fibrofatty pads that deform to accommodate various types of surfaces. In detail, these tufts detect deformation by tactile sensory receptors that respond to various stimuli such as the weight of the blade and the palpable sensation of the blade touching the cutting surface.

In order to achieve the preferred embodiment, the openings at the front lateral end and the rear lateral end are shaped in a circular fashion. For the preferred embodiment, the front lateral end has a smaller circumference than the rear lateral end. This will enable the present invention to slide easily over the finger, but still remain firm and secure without concern for sliding. However, users may have their own preferences or needs. Accordingly, alternate embodiments include a front lateral opening to be of the same size as the rear lateral opening. One of ordinary skill in the art would appreciate that there are many other suitable sizes and shapes of the openings and tubular body, and any combination of sizes and shapes thereof of the present invention can be adapted to accommodate the different sizes, fits, and comfortability preferences of the user.

Figure 11:
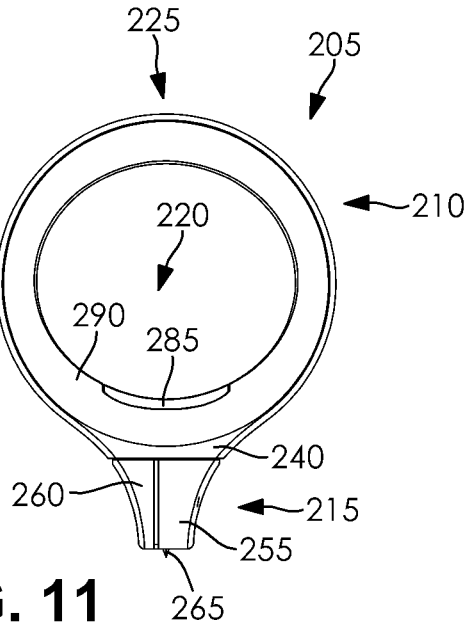
FIG. 11 is a rear view of an exemplary embodiment of the present invention.
Figure 11A:
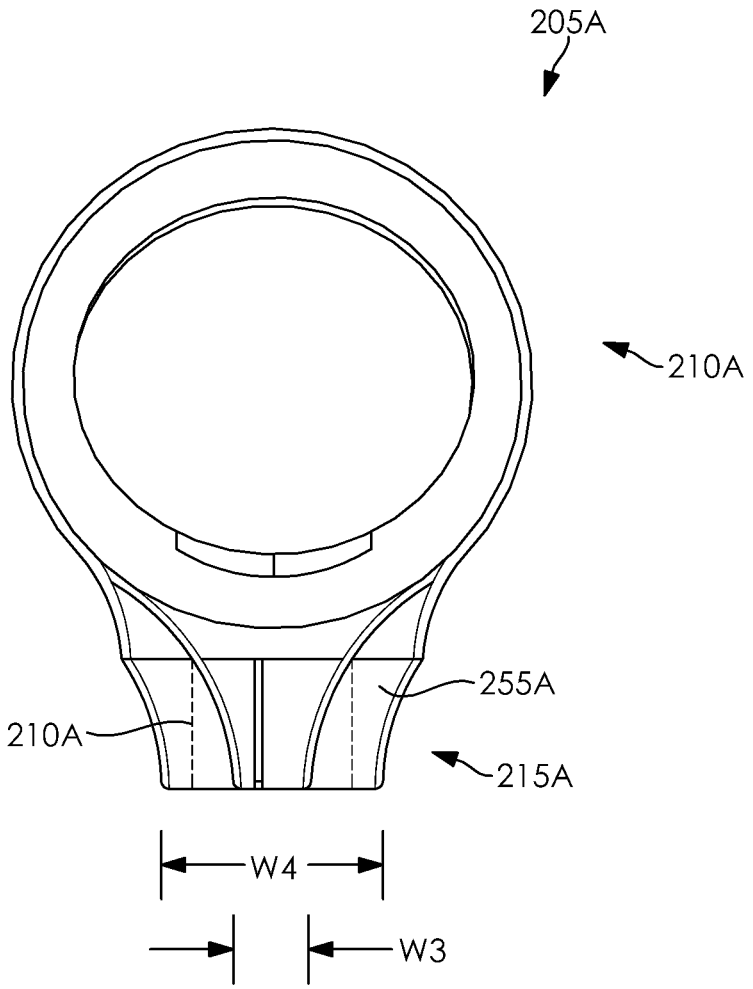
FIG. 11A is a rear view of another exemplary embodiment of the present invention.

According to embodiments of the present invention, the blade receiver forms on and extends from the bottom edge of the ring shaped body. According to the preferred embodiment of the present invention, the ring shaped body tapers into the blade receiver at the lateral sides as well as the front end and the rear end. These tapering configurations serve important roles in the use of the present invention. Firstly, as mentioned above, the blade is not visible during the intended use of the invention. Accordingly, the lateral tapering concentrates the area that receives the downward pressure force from depression of the finger. This permits the user to better sense the blade in order to decipher how much pressure is necessary for cutting a surface. Secondly, the lateral tapering assists with greater ability to balance the present invention. In at least some exemplary embodiments (for example as illustrated in FIG. 11A), less maintenance may be involved for balancing. Thirdly, the front and rear tapering configuration serves as a convenient guiding structure. As mentioned previously, tapering has the effect of concentrating weight. Since the front end and the rear end are mostly hollow, the tapering at the front and rear ends adds weight to these regions making it easier to glide the present invention along a cutting surface. In the preferred embodiments, the degree of tapering at the front end of the claimed invention is equal or similar to the degree of tapering occurring at the rear rend. In alternate embodiments (e.g., as illustrated in FIG. 11A), the degree of tapering between the front end and the rear end may differ to provide appropriate comfort and ease for use. For example as illustrated in FIG. 11A, an expanded base width may provide for increased lateral stability.

Figure 6:
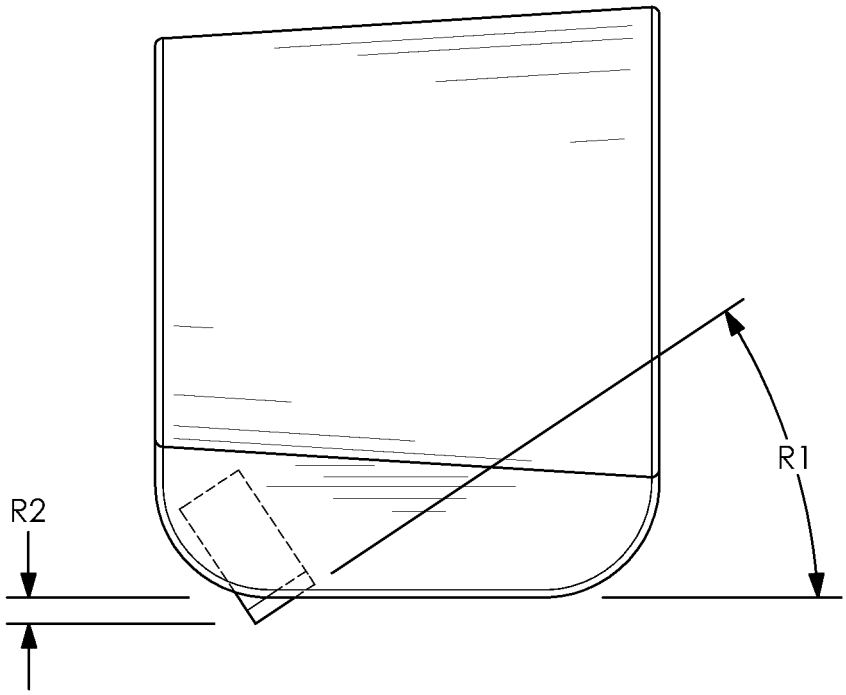
FIG. 6 is a is cross-sectional view of a safety cutter ring with its blade extended in accordance with an embodiment of the present invention.

The blade receiver comprises of at least two significant features: (i) a cavity and (ii) an aperture. The cavity serves to hold the blade. In connection, the aperture within the cavity permits the blade to be projected out from the cavity so it may make contact with a cutting surface. The blade can be affixed within the cavity in any convenient and suitable position as appropriate for the type of blade used. As illustrations (but not to serve as a limitation of the present invention), if the blade to be used where a fixed, single bevel blade, then it may be affixed within the cavity at angle sufficient for the cutting edge to meet the cutting surface. One of ordinary skill in the art would appreciate that a blade may be configured within the cavity in various orientations (e.g., as illustrated in FIG. 6 depicting a range of exemplary angles) depending on the type of blade utilized for a particular embodiment.

In the preferred embodiment, the aperture is situated only towards the front end. Having a small localized area from which the blade projects contributes to the safety features of the present invention since it minimizes the surface area of a cutting surface. However, alternative embodiments may include an aperture that traverses the length of the blade receiver, so that a longer cutting edge can be employed. Further, the dimensions of the aperture may vary depending on the type of blade used. For example, a ceramic blade, which is typically a thicker blade, may require a wider aperture than a steel blade. One of ordinary skill in the art would appreciate that the aperture may be configured for any size suitable for housing a blade.

In an alternative embodiment, the present invention is comprised of a body consisting of a holding member and an affixed blade receiver member. In this embodiment, the holding member does not taper into the blade receiver member; instead the holding member is a separate attached to the blade receiver member. The holding member has a tubular configuration and an opening at each a front end and a rear end. The blade receiver member comprises of a rectangular configuration, further comprising of (i) a cavity that retains the blade and (ii) an aperture within the cavity from which the blade project outwards towards the cutting area. As with the preferred embodiment, the holding member may also have front, rear, and/or lateral sides that taper towards the dorsal (bottom) end.

In an embodiment of the claimed invention, the holding member is affixed to the blade receiver member by use of an adhesive means such as glue or other types of fasteners. However, embodiments of the present invention also include using engineering (e.g. joinery) techniques to adhere pieces together without the use of adhesives. As an illustrative example (and not intended to serve as a limitation), the holding member may be joined to the blade receiver member by means of creating a dado joint such that an indent in the blade receiver member is capable of receiving a piece from the holding member. In some embodiments, the blade receiver member is removable to enable replacement of blade. One of ordinary skill in the art would appreciate that there are numerous ways to join the holding member to the blade receiver member, and embodiments of the present invention are contemplated to employ any such techniques and methodologies for joining pieces.

Further embodiments of the present invention include iterations where there are two or more ring shaped bodies to permit additional fingers to be received. For example, an embodiment may include a holding member with three openings (for each the index finger, the middle finger, and the ring finger). Similarly, an embodiment may include three ring shaped bodies connected to each other so that a user is able to receive sturdier support to control the movement of the blade receiver portion (or blade receiver member).

It is envisioned that the claimed invention can utilize any type of blade without restrictions on type of blade edge or the material to be used. Types of blade edge include a standard box cutter blade and a utility blade. Such blades may have any variety of tips, including rounded tips to reduce the chance of injury, V (flat) tip, asymmetrical semi convex, asymmetrical V (flat), compound (double) bevel, chisel, chisel with back bevel, and chisel with urasuki geometry. As is evident in the non-limiting list of potential blade types, embodiments of the present invention include blades that have more than one cutting edge. Accordingly, this will enable the present invention to cut a surface in both the forward-moving and rear-moving direction. Further, the blade can be made from any suitable material, including, but not limited to metal, ceramic, tempered steel, stainless steel, high carbon steel, titanium, diamond, and obsidian. One of ordinary skill in the art would appreciate that there are numerous configurations and materials that might be used for the blade, and embodiments of the present invention are contemplated for use with any material or configuration.

In alternate embodiments, the claimed invention further comprises of a removable insert that can accommodate smaller fingers. The insert itself is comprised of a cylindrical body with openings at each end. When there is a user with smaller fingers (such as younger child), the insert can slide within the ring shaped body yielding an all-around cushioning for inserted finger for a more comfortable fit. In the preferred embodiment, the insert is comprised of silicone.

Turning now to FIG. 1, a perspective view of the safety cutter ring, in accordance with an embodiment of the present invention illustrating the front face of the present invention. In the preferred embodiment, the safety cutter ring 100 is comprised of a ring shaped body 101, a blade receiver 102, and a blade 103 projecting from a cavity (not shown) within blade receiver through an aperture (not shown). The ring shaped body 101 comprises of an opening at a front end 104 (of the ring shaped body) and a rear end (not shown). This embodiment illustrates the tapering configuration from the ring shaped body to the blade receiver at the end 108 (of the blade receiver) and the front end 107 (of the blade receiver).

Figure 2:
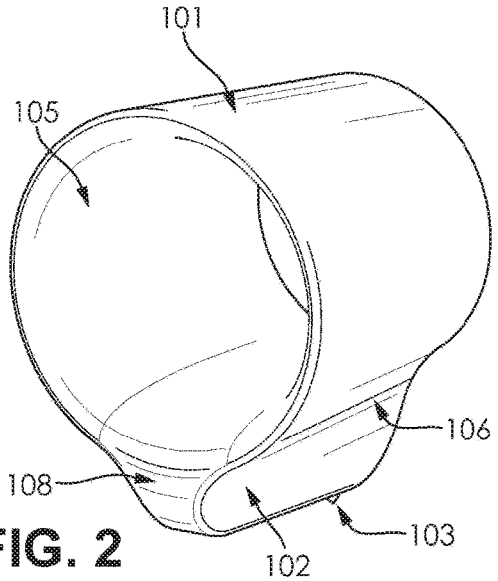
FIG. 2 is a rear perspective view of a safety cutter ring with its blade extended in accordance with an embodiment of the present invention.

Turning now to FIG. 2, a perspective view of the safety cutter ring in accordance with an embodiment of the present invention illustrating the rear face of the present invention. In the preferred embodiment, the safety cutter ring 100 has an opening at the rear end 105 (of the ring shaped body) which is bigger than the opening at the front end (of the ring shaped body). Due to the differences in sizes between the front end (of the ring shaped body) and the rear end (of the ring shaped body) in the presented embodiment, the degree of tapering at the front end (of the blade receiver) differs from the degree of tapering at the rear end 108 (of the blade receiver). In detail the tapering at the front end (of the blade receiver) is longer in distance and narrower than the tapering at the rear end 108 (of the blade receiver). However, in alternate embodiments where the openings at the front end 104 (of the ring shaped body) and rear end 105 (of the ring shaped body) are of the same size, the tapering at the front end 107 (of the blade receiver) is identical to the tapering at the rear end 108 (of the blade receiver).

Figure 3:
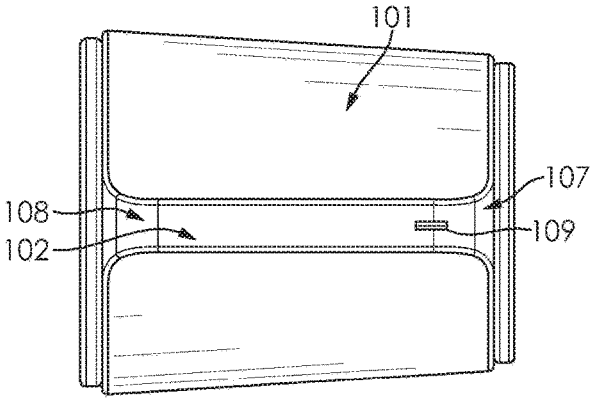
FIG. 3 is a bottom/dorsal perspective view of a safety cutter ring with its blade extended in accordance with an alternate embodiment of the present invention.
Figure 4:
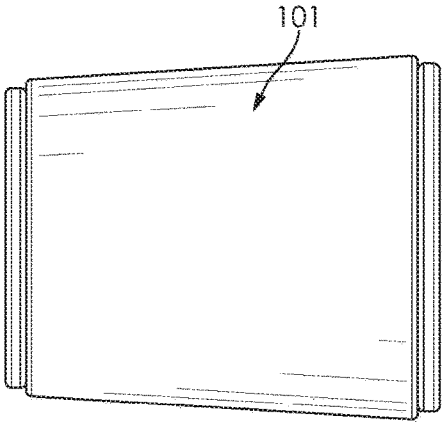
FIG. 4 is a top perspective view of a safety cutter ring in accordance with an alternate embodiment of the present invention.
Figure 3A:
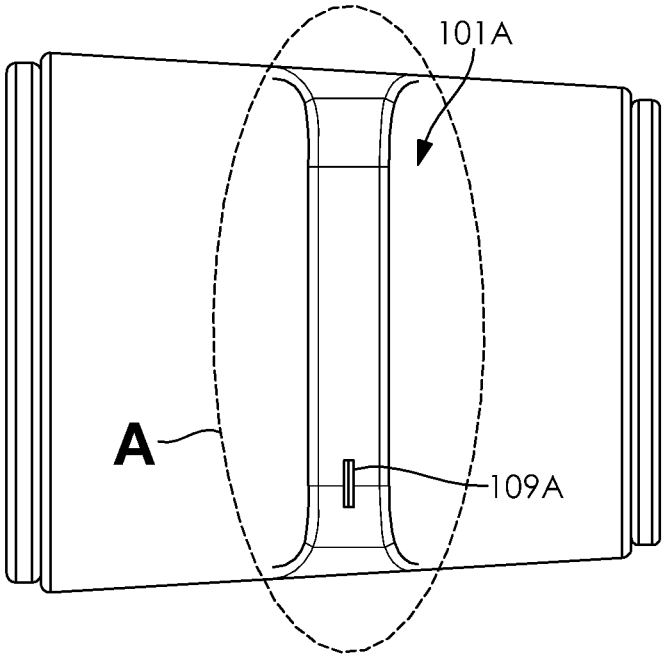
FIG. 3A is a bottom/dorsal perspective view of a safety cutter ring with its blade extended in accordance with another alternate embodiment of the present invention.
Figure 3B:
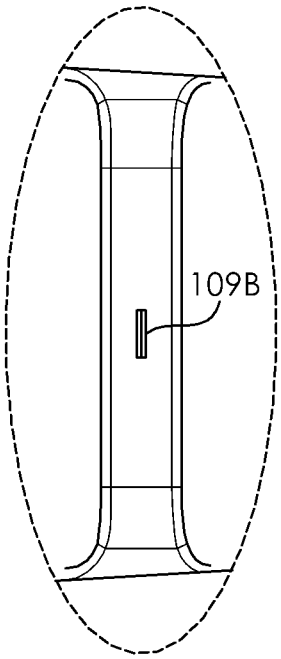
FIG. 3B is a partial bottom/dorsal perspective view of a safety cutter ring with its blade extended in accordance with another alternate embodiment of the present invention.
Figure 3C:
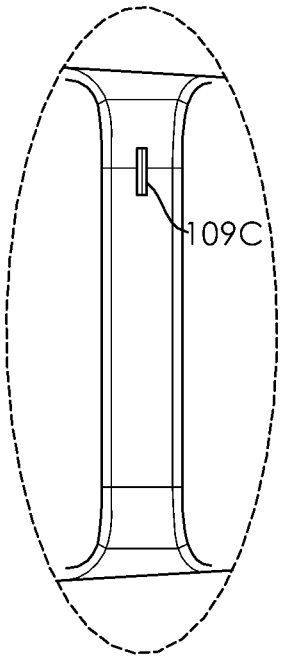
FIG. 3C is a partial bottom/dorsal perspective view of a safety cutter ring with its blade extended in accordance with another alternate embodiment of the present invention.

Turning now to FIG. 3, and FIG. 4, perspective views of the safety cutter ring in accordance with an embodiment of the present invention respectively illustrating a bottom face, and a top face of the present invention. The underside view of FIG. 3 illustrates an aperture 109 from which the blade protrudes. FIGS. 3A, 3B, and 3C illustrate alternative exemplary blade positions. For example, FIG. 3A illustrates a ring shaped body 101A having an aperture 109A located at an alternative exemplary location A from which the blade may project. FIGS. 3B and 3C illustrate respective apertures 109B and 109C located at alternative exemplary locations from which a blade may project.

Figure 5:
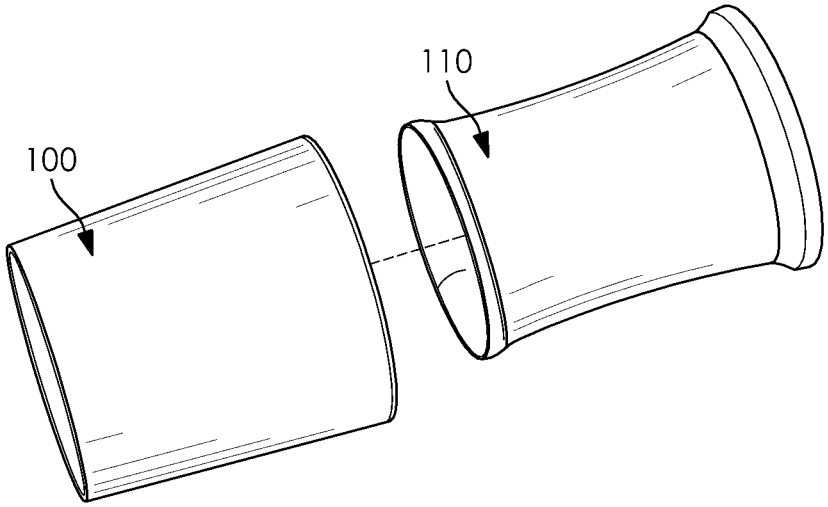
FIG. 5 is a top perspective view of a safety cutter ring in accordance with an alternate embodiment of the present invention.

Turning now to FIG. 5, a perspective view of the safety cutter ring in accordance with an embodiment of the present invention with an insert 110.

FIG. 6 is a vertical cross sectional view of an embodiment of the present invention without an insert. It shows a cavity 106 retaining a blade 103 extending through an aperture (not shown) to make contact with a cutting surface. FIG. 6 illustrates a range R1 of exemplary angles at which blade 103 may be disposed. FIG. 6 also illustrates a range R2 of exemplary depths at which blade 103 may protrude from blade receiver 102.

FIGS. 7-13 illustrate another exemplary embodiment of the exemplary disclosed apparatus and method. As illustrated in FIGS. 7-13, a cutting device 205 may include a body member 210 and a cutting assembly 215. Body member 210 may for example receive a user's finger or thumb and may be attached to cutting assembly 215.

Body member 210 may be a flexible structural member that forms a cavity 220 configured to receive a user's finger. Body member 210 may include a wall portion 225 and a base portion 240. Wall portion 225 of body member 210 may be integrally formed with (e.g., or attached to) base portion 240 of body member 210. Wall portion 225 and base portion 240 of body member 210 may form cavity 220. Wall portion 225 may be a relatively thin elliptical or circular wall that may be elongated (e.g., along with base portion 240) to form cavity 220 as an elongated aperture or through-hole extending through an entire longitudinal length of body member 210. For example, wall portion 225 may be a ring-shaped wall that extends from base member 240, and body member 210 may be a ring-shaped member configured to receive a user's finger in and/or through cavity 220.

Figure 9:
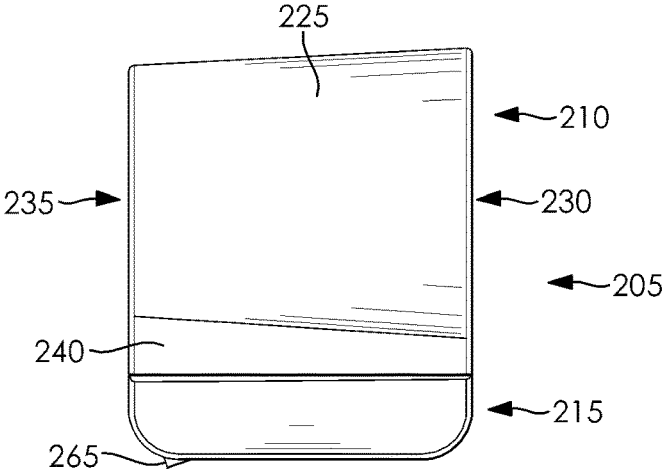
FIG. 9 is a side view of an exemplary embodiment of the present invention.
Figure 12:
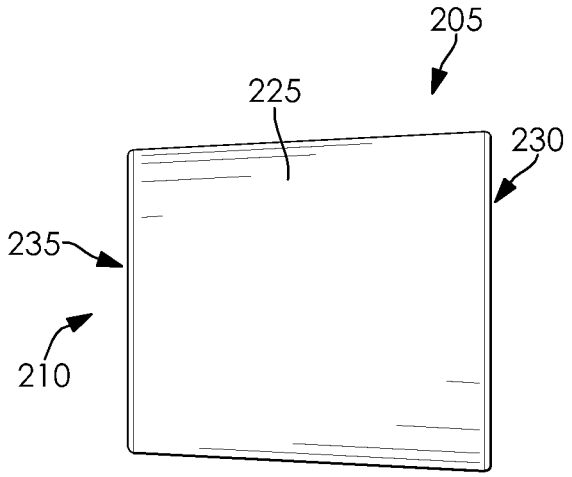
FIG. 12 is a top view of an exemplary embodiment of the present invention.
Figure 13:
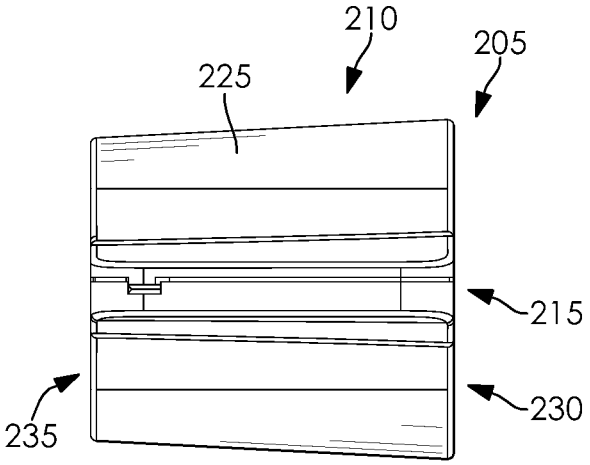
FIG. 13 is a bottom view of an exemplary embodiment of the present invention.

As illustrated in FIGS. 9, 12, and 13, a height of wall portion 225 may be flared or tapered along a length of body member 210. For example, a height of wall portion 225 may decrease from a rear portion 230 to a front portion 235 of body member 210. Cavity 220 may thereby decrease in size (e.g., a width or diameter of cavity 220 may decrease) in a direction moving from rear portion 230 to front portion 235 along a longitudinal direction or length direction of body member 210.

As illustrated in FIG. 9, although a height and/or width of wall portion 225 may be flared or tapered, an overall height of body member 210 and cutting device 205 may remain substantially constant. For example, as a height of wall portion 225 decreases in a direction moving from rear portion 230 toward front portion 235, a height of base portion 240 may increase in a direction moving from rear portion 230 toward front portion 235. For example, an increase in a height of base portion 240 may be substantially equal to a decrease in a height of wall portion 225 so that an overall height of body member 210 and cutting device 205 may remain substantially constant across a length of cutting device 205. Alternatively for example, the overall height of body member 210 and cutting device 205 may be flared or tapered. As illustrated in FIGS. 9, 12, and 13, the tapered shape of wall portion 225 (e.g., of cavity 220) may help to securely or snugly attach cutting device 205 to a user's finger or thumb that is inserted into cavity 220 at rear portion 230 and moved forward into tapered cavity 220 toward and/or past front portion 235.

Figure 15:
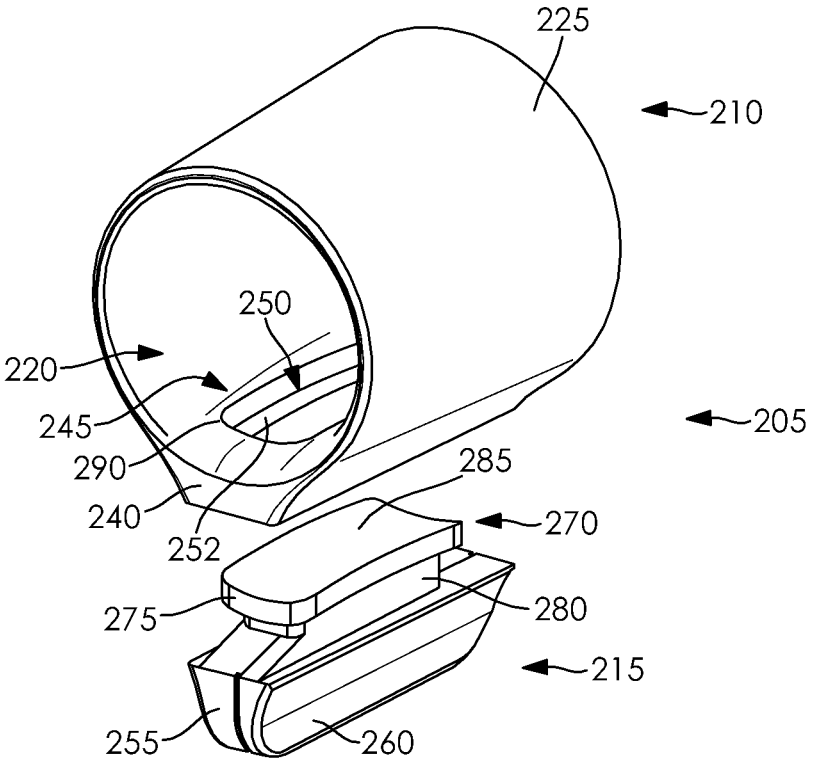
FIG. 15 is a perspective view of an exemplary embodiment of the present invention.

As illustrated in FIG. 15, body member 210 may include an aperture 245. For example, base portion 240 (e.g., and/or wall portion 225) may include aperture 245 for receiving one or more portions of cutting assembly 215. Aperture 245 may form a through-hole through body member 210. For example, aperture 245 may extend from cavity 220 to an exterior of body member 210. Aperture 245 may include a protrusion 250 (e.g., a lip portion or a stepped portion) that may have a shape that receives and corresponds to a portion of cutting assembly 215.

Body member 210 (e.g., including wall portion 225 and base portion 240) may be a flexible member. For example, body member 210 may be formed from relatively soft plastic and/or polymer materials. In at least some exemplary embodiments, body member 210 may be formed from silicone (e.g., silicone rubber). Body member 210 may be formed from thermoplastic material (e.g., thermoplastic polymers), thermosetting elastomer material (e.g., elastic polymer and/or thermosetting polymer), natural rubber, and/or synthetic rubber. Body member 210 may include materials such as styrenic block copolymers (TPE-s), thermoplastic olefins (TPE-o), elastomeric alloys (TPE-v or TPV), thermoplastic polyurethanes (TPU), thermoplastic copolyester (TPE-E), and/or thermoplastic polyamides. For example, body member 210 may be formed from any suitable cushioning material. Body member 210 may be formed from material having durometer scale (e.g., durometer scale of Shore A) values that are "soft," "medium soft," and/or "medium hard" as measured on a Shore Hardness Scale. For example, body member 210 may be formed from material having Shore A Hardness values of between about 5 A and about 80 A. For example, body member 210 may be formed from "soft," "medium soft," and/or "medium hard" material having Shore A Hardness values of between about 8 A and about 80 A, between about 15 A and about 70 A, between about 25 A and about 60 A, and/or between about 30 A and about 60 A. For example, body member 210 may be formed from "soft" and/or "medium soft" material having Shore A Hardness values of between about 15 A and about 60 A, between about 20 A and about 50 A, between about 20 A and about 45 A, and/or between about 25 A and about 40 A.

Returning to FIGS. 7-13, cutting assembly 215 may be attached (e.g., fixedly attached) to body member 210. In at least some exemplary embodiments, cutting assembly 215 may be removably attachable to body member 210. Cutting assembly 215 may include a member 255 and a member 260.

Figure 14:
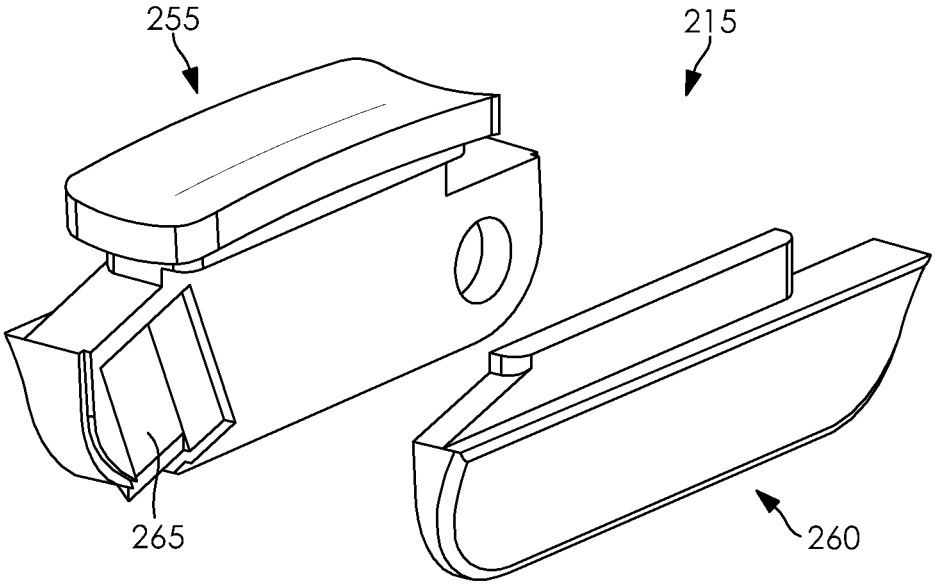
FIG. 14 is a perspective view of an exemplary embodiment of the present invention.

Member 255 may receive a cutting member 265. Cutting member 265 may be a blade formed from any suitable material for cutting material. For example, cutting member 265 may be ceramic material such as Zirconium Oxide. Cutting member 265 may also be formed from a metallic material (e.g., metal such as steel) or any other suitable material for forming a blade. As illustrated in FIG. 14, cutting member 265 may be received in a recess or cavity (e.g., a pocket) of member 255.

Member 255 (e.g., including cutting member 265) may be attached to member 260 by any suitable technique. For example, member 255 and member 260 may be attached by ultra-sonic welding, adhesive, and/or any other suitable technique. As illustrated in FIGS. 7-11, a portion of cutting member 265 may protrude out from between member 255 and member 260 when members 255 and 260 are attached.

Members 255 and 260 may have any suitable widths. For example as illustrated in FIG. 11A, a cutting device 205A that may be similar to cutting device 205 may have a body member 210A that may be similar to body member 210 and a cutting assembly 215A that may be similar to cutting assembly 215. Cutting assembly 215A may include members 255A and 260A that may be similar to members 255 and 260, respectively. Cutting assembly 215A (e.g., including members 255A and 260A) may have any suitable width such as, for example, a width within a range between width W3 and width W4 as illustrated in FIG. 11A. For example as illustrated in FIG. 11A, an expanded base width of cutting assembly 215A (e.g., of between or including width W3 and width W4) may provide for increased lateral stability.

Cutting assembly 215 (e.g., including member 255 and member 260) may be formed from any suitable plastic material and/or material with stiffness or hardness similar to hard plastic such as metal, wood, composite material, or other suitable material. Cutting assembly 215 may be formed from hard plastic material. For example, cutting assembly 215 may be formed from polymer materials and plastic materials, e.g., thermoplastic and thermosetting polymers, resins and elastomers, polyethylene, polystyrene, polypropylene, epoxy resins, phenolic resins, and/or any other suitable material having desired strength for forming structural components of cutting device 205. Cutting assembly 215 may be formed from material having durometer scale (e.g., durometer scale of Shore A or Shore D) values that are "medium hard," "hard," or "extra hard" as measured on a Shore Hardness Scale. For example, cutting assembly 215 may be formed from material having Shore A Hardness values of between about 70 A and about 100 A, between about 80 A and about 100 A, or greater than 90 A. Also for example, cutting assembly 215 may be formed from material having Shore D Hardness values of between about 10 D and about 100 D, between about 40 D and about 100 D, between about 60 D and about 100 D, and/or between about 70 D and about 90 D. For example, cutting assembly 215 may be formed from "extra hard" material having Shore D Hardness values of between about 70 D and about 95 D, between about 75 D and about 90 D, and/or between about 80 D and about 90 D (e.g., about 80 D or about 85 D).

In at least some exemplary embodiments, body member 210 may be formed from a material that is more flexible than a material of cutting assembly 215 so that body member 210 is more flexible than cutting assembly 215. Also for example, cutting assembly 215 may be formed from a material having a higher hardness (e.g., on a durometer scale such as Shore A and/or Shore D) than a material of body member 210 so that cutting assembly 215 is harder than body member 210. Further for example, cutting assembly 215 may be formed from a material having a higher stiffness than a material of body member 210 so that cutting assembly 215 is stiffer than body member 210. For example, cutting assembly 215 may be formed from material having a greater (e.g., higher) modulus of elasticity (e.g., elastic modulus) than material of body member 210.

Figure 16:
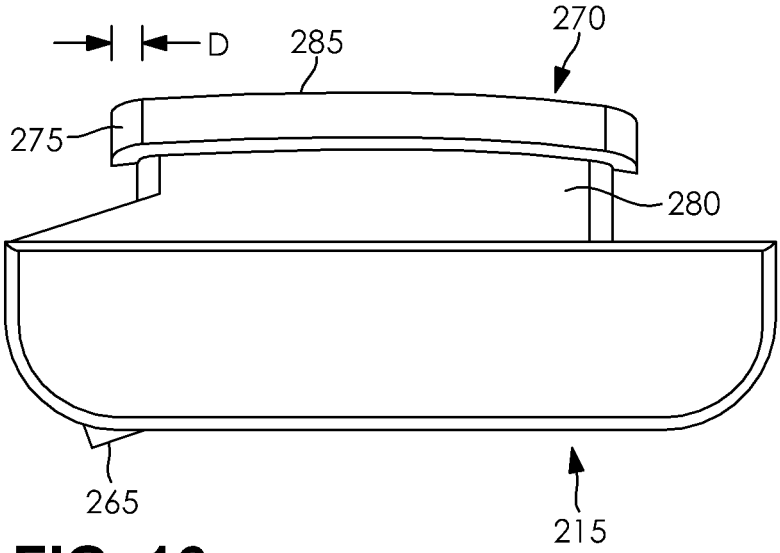
FIG. 16 is a side view of an exemplary embodiment of the present invention.

As illustrated in FIGS. 15 and 16, cutting assembly 215 may include a portion 270 that may be disposed at an end portion (e.g., an upper portion) of cutting assembly 215. Portion 270 may include a protrusion 275 (e.g., a protruding portion) that may protrude beyond an adjacent portion 280. For example, portion 270 and protrusion 275 may form a flange of cutting assembly 215. For example as illustrated in FIG. 16, protrusion 275 may extend a distance D (e.g., a flange depth) beyond an edge portion (e.g., an exterior surface) of portion 280. Distance D may be between about 1 mm (millimeter) and about 2 mm, e.g., to facilitate a mechanical interlock between body member 210 and cutting assembly 215 as described for example herein. For example, distance D may be about 1.5 mm. Protrusion 275 may have a shape that corresponds to a shape of aperture 245 (e.g., protrusion 250) of body member 210. As illustrated in FIG. 15, protrusion 250 may include a surface 252 having a width that is substantially equal (e.g., equal) to distance D (e.g., so that protrusions 250 and 275 correspond in length).

Figure 7:
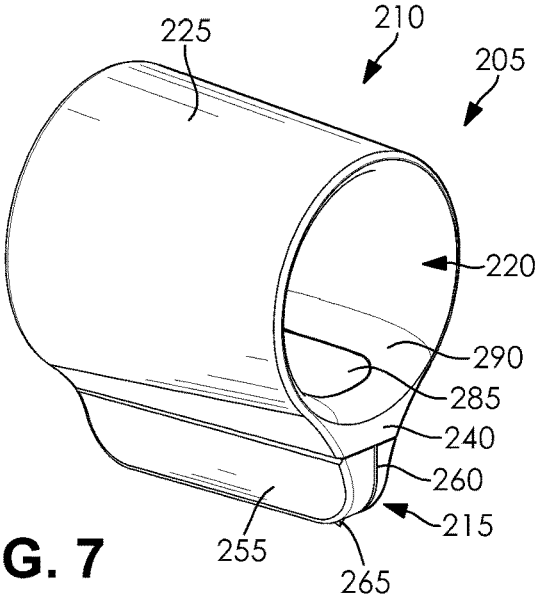
FIG. 7 is a perspective view of an exemplary embodiment of the present invention.
Figure 8:
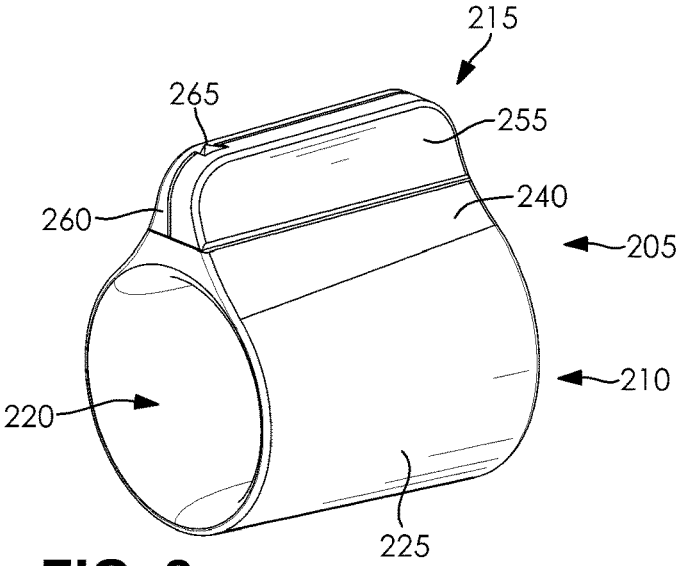
FIG. 8 is a perspective view of an exemplary embodiment of the present invention.
Figure 10:
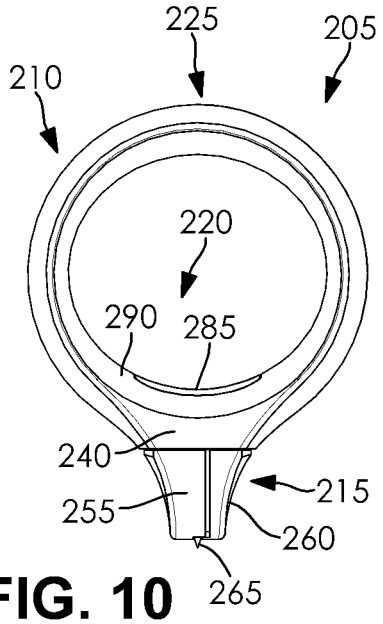
FIG. 10 is a front view of an exemplary embodiment of the present invention.

Portion 270 of cutting assembly 215 may be inserted or disposed within aperture 245 of body member 210 so that protrusion 275 is received by aperture 245. For example, when portion 270 of cutting assembly 215 is disposed within aperture 245 of body member 210, protrusion 275 may abut against protrusion 250 of aperture 245. As illustrated in FIGS. 7, 10, and 11, portion 270 may be shaped to fit within aperture 245 (e.g., with protrusions 250 and 275 abutting substantially fully with each other) so that a surface 285 (e.g., upper or exterior surface) of portion 270 may be substantially flush with a surface 290 (e.g., interior surface) of body member 210. For example, portions 270 and 280 of cutting assembly 215 may substantially entirely fill aperture 245.

In at least some exemplary embodiments, cutting device 205 may be manufactured using any suitable assembly technique for providing mechanical interlock of cutting assembly 215 and body member 210. As described for example above, cutting assembly 215 (e.g., including portions 270 and 280) may be stiffer and/or harder than body member 210 (e.g., and/or body member 210 may be more flexible than cutting assembly 215). Accordingly, body member 210 may deform (e.g., flex) so that portions 270 and 280 may be inserted into aperture 245. For example, relatively more flexible body member 210 may deform (e.g., flex) so that aperture 245 increases and/or changes dimensions to receive portions 270 and 280 as they are inserted into aperture 245. It may be relatively easy for a fabricator or user to insert portions 270 and 280 into aperture 245. Once portions 270 and 280 are fully inserted into aperture 245 as illustrated for example in FIGS. 7, 10, and 11, it may be relatively difficult for portions 270 and 280 to be removed from aperture 245 based on the relative stiffness (e.g., and/or hardness and flexibility) of body member 210 and cutting assembly 215 described for example above. For example, the relative stiffness (e.g., and/or hardness and flexibility) of body member 210 and cutting assembly 215 described above may provide for a suitable mechanical interlock to substantially prevent cutting assembly 215 from being removed from body member 210 while cutting device 205 is being used, e.g., to cut material. Accordingly, once portions 270 and 280 are fully inserted into aperture 245 as illustrated for example in FIGS. 7, 10, and 11, cutting assembly 215 may be permanently attached (e.g., substantially permanently attached) to body member 210 during a use of cutting device 205 by a user. For example, cutting assembly 215 may be permanently or fixedly attached to body member 210 during use of cutting device 205 for cutting material. Accordingly for example, a user may use cutting device 205 for cutting material without cutting assembly 215 dislodging or coming loose from body member 210 (e.g., based on the exemplary relative stiffness, hardness, and/or flexibility of materials of cutting assembly 215 and body member 210 described above). Also for example, to remove cutting assembly 215 from body member 210, any suitable fabrication or manufacturing equipment and/or techniques may be used. In at least some exemplary embodiments, cutting assembly 215 may not be removed from body member 210 (e.g., may not be disassembled, stretched apart, broken, separated by force, separated by temperature, or removed in any way).

In at least some exemplary embodiments, cutting device 205 may be manufactured using any suitable molding technique. In at least some exemplary embodiments, cutting member 265 may be placed into a cavity (e.g., a pocket) of member 255 (e.g., a holder such as a hard plastic holder). Member 260 (e.g., a cover such as a hard plastic cover) may be welded to member 255, thereby securing (e.g., capturing) cutting member 265 and assembling cutting assembly 215. Assembled cutting assembly 215 may then be placed into a tool such as an insert molding tool or a vertical over-molding tool, and material that may be similar to the material of body member 210 described above may be injected around cutting assembly 215 (e.g., to manufacture body member 210). This exemplary injection may provide for mechanical interlock of cutting assembly 215 by molding material of body member 210 around portions of cutting assembly 215 (e.g., portions 270 and 280). Accordingly for example, the material (e.g., silicone or other suitable material for example as described above) of body member 210 may capture (e.g., fully capture) cutting assembly 215 (e.g., portions 270 and 280).

In at least some exemplary embodiments, it is also contemplated that body member 210 may be glued to cutting assembly 215. It is also contemplated that body member 210 may be welded to cutting assembly 215.

In at least some exemplary embodiments, the exemplary disclosed cutting device may include a body member (e.g., body member 210) formed from a first material and including a cavity (e.g., cavity 220) extending along a length of the body member from a first end of the body member to a second end of the body member that is disposed on an opposite side of the body member as the first end, a cutting assembly (e.g., cutting assembly 215) formed from a second material and attached to the body member, the cutting assembly including a protrusion, and a cutting member disposed on the cutting assembly. The body member may include an aperture extending from the cavity to a third end of the body member that is disposed between the first and second ends. The cutting assembly may be attached to the body member based on the protrusion being received in the aperture. The first material may be more flexible than the second material. The second material may have a higher hardness on a durometer scale than the first material. The first material may have a durometer scale value that is "soft" or "medium soft" on a Shore Hardness Scale. The second material may have a durometer scale value that is "hard" or "extra hard" on a Shore Hardness Scale. The first material may be silicone rubber. The protrusion may be a flange that protrudes from an adjacent portion of the cutting assembly by a protruding distance that is between 1 and 2 millimeters. The cutting assembly may be attached to the body member based on the protrusion formed from the second material being received in the aperture that includes an aperture protrusion formed from the first material and having a width that is equal to the protruding distance. The body member may be ring-shaped and the cavity may be a user finger through-hole. An interior wall of the body member forming the cavity may taper inward from the first end that is a rear end of the body member to the second end that is a front end of the body member. The body member may include a wall portion, which includes the interior wall, and a base portion that increases in height from the rear end to the front end of the body member so that the body member maintains a constant overall height as the interior wall tapers inward from the rear end to the front end. The cutting assembly may include a holder member having an aperture that receives the cutting member and a cover member that is ultra-sonic welded to the holder member over the cutting member. The cutting member may be a ceramic blade that is disposed at an angle relative to the length of the body member.

In at least some exemplary embodiments, the exemplary disclosed cutting device may include a body member (e.g., body member 210) formed from a first material and including a cavity (e.g., cavity 220) extending along a length of the body member from a first end of the body member to a second end of the body member that is disposed on an opposite side of the body member as the first end, a cutting assembly (e.g., cutting assembly 215) formed from a second material and attached to the body member, the cutting assembly including a protrusion, and a cutting member disposed on the cutting assembly. The body member may include an aperture extending from the cavity to a third end of the body member that is disposed between the first and second ends. The cutting assembly may be attached to the body member based on the protrusion being received in the aperture. The second material may have a greater stiffness than the first material. The second material may have a higher modulus of elasticity than the first material. The first material may have a Shore A Hardness value of between about 20 A and about 45 A. The second material may have a Shore D Hardness value of between about 70 D and about 95 D. The body member may be ring-shaped and the cavity may be a user finger through-hole.

In at least some exemplary embodiments, the exemplary disclosed cutting device may include a ring-shaped body member (e.g., body member 210) formed from a first material and including a through-hole extending along a length of the ring-shaped body member from a first end of the ring-shaped body member to a second end of the ring-shaped body member that is disposed on an opposite side of the ring-shaped body member as the first end, a cutting assembly (e.g., cutting assembly 215) formed from a second material and attached to the ring-shaped body member, the cutting assembly including a flange, and a ceramic blade disposed on the cutting assembly. The ring-shaped body member may include an aperture extending from the through-hole to a third end of the ring-shaped body member that is disposed between the first and second ends. The cutting assembly may be attached to the ring-shaped body member based on the flange being received in the aperture. The first material may be silicone rubber and the second material may be stiffer than silicone rubber. The flange may protrude from an adjacent portion of the cutting assembly by a protruding distance that is 1.5 millimeters. The cutting assembly may be attached to the ring-shaped body member based on the flange formed from the second material being received in the aperture that includes an aperture protrusion formed from silicone rubber and having a width that is equal to the protruding distance.

The exemplary disclosed device and method may be used in any application involving cutting materials. For example, the exemplary cutting device and method may be used in any suitable application such as in warehouses, shipping and receiving departments, retail and grocery stores, and restaurants and fast food establishments.

The exemplary disclosed cutting device and method may provide an efficient and effective device and technique for safe bracing and cutting of material. The exemplary disclosed cutting device and method may avoid loss or misplacement of the exemplary disclosed cutting device by allowing the user to comfortably retain the cutting device on the user's finger.

It should be noted that features illustrated in the drawings are not necessarily drawn to scale, and features of one embodiment may be employed with other embodiments as the skilled artisan would recognize, even if not explicitly stated herein.

While multiple embodiments are disclosed, still other embodiments of the present invention will become apparent to those skilled in the art from this detailed description. The invention is capable of myriad modifications in various obvious aspects, all without departing from the spirit and scope of the present invention. Accordingly, the drawings and descriptions are to be regarded as illustrative in nature and not restrictive.

What is claimed is:

1. A cutting device, comprising:

a body member formed from a first material and including a cavity extending along a length of the body member from a first end of the body member to a second end of the body member that is disposed on an opposite side of the body member as the first end;

a cutting assembly formed from a second material and attached to the body member, the cutting assembly including a protrusion; and a cutting member disposed on the cutting assembly;

wherein the body member includes an aperture extending from the cavity to a third end of the body member that is disposed between the first and second ends;

wherein the cutting assembly is attached to the body member based on the protrusion being received in the aperture;

wherein the first material is more flexible than the second material; and wherein the cutting assembly includes a holder member having an aperture that receives the cutting member, and a cover member that is attached to the holder member over the cutting member.

2. The cutting device of claim 1, wherein the second material has a higher hardness on a durometer scale than the first material.

3. The cutting device of claim 1, wherein the first material has a durometer scale value that is "soft" or "medium soft" on a Shore Hardness Scale.

4. The cutting device of claim 1, wherein the second material has a durometer scale value that is "hard" or "extra hard" on a Shore Hardness Scale.

5. The cutting device of claim 1, wherein the first material is silicone rubber.

6. The cutting device of claim 1, wherein the protrusion is a flange that protrudes from an adjacent portion of the cutting assembly by a protruding distance that is between 1 and 2 millimeters.

7. The cutting device of claim 6, wherein the cutting assembly is attached to the body member based on the flange formed from the second material being received in the aperture that includes an aperture protrusion formed from the first material and having a width that is equal to the protruding distance.

8. The cutting device of claim 1, wherein the body member is ring-shaped and the cavity is a user finger through-hole.

9. The cutting device of claim 1, wherein an interior wall of the body member forming the cavity tapers inward from the first end that is a rear end of the body member to the second end that is a front end of the body member.

10. The cutting device of claim 9, wherein the body member includes a wall portion, which includes the interior wall, and a base portion that increases in height from the rear end to the front end of the body member.

11. The cutting device of claim 1, wherein the cover member is ultra-sonic welded to the holder member over the cutting member.

12. The cutting device of claim 1, wherein the cutting member is a ceramic blade that is disposed at an angle relative to the length of the body member.

13. A cutting device, comprising:

a body member formed from a first material and including a cavity extending along a length of the body member from a first end of the body member to a second end of the body member that is disposed on an opposite side of the body member as the first end;

a cutting assembly formed from a second material and attached to the body member, the cutting assembly including a protrusion; and a cutting member disposed on the cutting assembly;

wherein the body member includes an aperture extending from the cavity to a third end of the body member that is disposed between the first and second ends;

wherein the cutting assembly is attached to the body member based on the protrusion being received in the aperture;

wherein the second material has a greater stiffness than the first material; and wherein the cutting assembly is attached to the body member based on the protrusion formed from the second material being received in the aperture that includes an aperture protrusion formed from the first material.

14. The cutting device of claim 13, wherein the second material has a higher modulus of elasticity than the first material.

15. The cutting device of claim 13, wherein the first material has a Shore A Hardness value of between about 20 A and about 45 A.

16. The cutting device of claim 13, wherein the second material has a Shore D Hardness value of between about 70 D and about 95 D.

17. The cutting device of claim 13, wherein the body member is ring-shaped and the cavity is a user finger through-hole.

18. A cutting device, comprising:

a ring-shaped body member formed from a first material and including a through-hole extending along a length of the ring-shaped body member from a first end of the ring-shaped body member to a second end of the ring-shaped body member that is disposed on an opposite side of the ring-shaped body member as the first end;

a cutting assembly formed from a second material and attached to the ring-shaped body member, the cutting assembly including a flange; and a ceramic blade disposed on the cutting assembly;

wherein the ring-shaped body member includes an aperture extending from the through-hole to a third end of the ring-shaped body member that is disposed between the first and second ends;

wherein the cutting assembly is attached to the ring-shaped body member based on the flange being received in the aperture;

wherein the first material is silicone rubber and the second material is stiffer than silicone rubber; and wherein the cutting assembly is attached to the ring-shaped body member based on the flange formed from the second material being received in the aperture that includes an aperture protrusion formed from silicone rubber.

19. The cutting device of claim 18, wherein the flange protrudes from an adjacent portion of the cutting assembly by a protruding distance that is 1.5 millimeters.

20. The cutting device of claim 19, wherein the aperture protrusion has a width that is equal to the protruding distance.

* * * * *